US005765584A

United States Patent [19]

Heisler et al.

[11] Patent Number: 5,765,584

[45] Date of Patent: Jun. 16, 1998

[54] TENT DOOR CAPABLE OF HIGH/LOW VENTILATION

[75] Inventors: Kurt Heisler, McDonough; James M. Remza, Binghamton, both of N.Y.

[73] Assignee: Johnson Worldwide Associates, Inc., Sturtevant, Wis.

[21] Appl. No.: 502,867

[22] Filed: Jul. 14, 1995

[51] Int. Cl.[6] ..... E04H 15/14

[52] U.S. Cl. ..... 135/93; 135/117

[58] Field of Search ..... 135/91, 93, 115, 135/117, 119, 97, 124, 120.1, 120.3, 909, 126

[56] References Cited

U.S. PATENT DOCUMENTS

| | | | |
|---|---|---|---|
| 1,856,658 | 5/1932 | Rummler | 135/93 |
| 3,052,249 | 9/1962 | Seaman et al. | 135/117 X |
| 3,356,098 | 12/1967 | Krutzikowsky | 135/117 X |
| 3,547,136 | 12/1970 | Prinz et al. | 135/117 X |
| 3,880,459 | 4/1975 | Kelley | 135/93 X |
| 3,929,145 | 12/1975 | Schroeder | 135/93 X |
| 4,165,757 | 8/1979 | Marks | 135/1 R |
| 4,612,948 | 9/1986 | Simpson | 135/117 X |
| 5,078,096 | 1/1992 | Bishop et al. | 119/19 |
| 5,394,897 | 3/1995 | Ritchey et al. | 135/124 |

FOREIGN PATENT DOCUMENTS

| | | | |
|---|---|---|---|
| 564756 | 7/1960 | Belgium | 135/93 |
| 551444 | 1/1958 | Canada | 135/93 |

OTHER PUBLICATIONS

The North Face Catalog, Spring 1995, pp. 16–23.
Sierra Designs Catalog, Fall 1995, pp. 29–36.
Mountain Hardwear Catalog, Fall 1995, pp. 41 and 43.
Kelty Catalog, 1995, pp. 30–37.
Quest Catalog, 1995, pp. 6–29.

*Primary Examiner*—Michael Safavi
*Attorney, Agent, or Firm*—Foley & Lardner

[57] ABSTRACT

A tent has a two-ply door having an air venting fabric as a first ply and a waterproof fabric as a second ply. On the waterproof fabric, a continuous zipper which defines a c-shaped arcuate path is formed. The zipper starts at a side of the tent door and ends at the same side. Zipper slides are mounted on the zipper path, such that a pair of consecutively positioned zipper slides unzips the waterproof fabric to allow ventilation through the air venting fabric when the pair slides towards one another and zips the waterproof fabric to close off ventilation when the pair slides away from each other. Operation of a first of the pair provides ventilation through the top of the air venting fabric and operation of the other provides ventilation through the bottom of the air venting fabric.

20 Claims, 2 Drawing Sheets

TENT DOOR CAPABLE OF HIGH/LOW VENTILATION

BACKGROUND OF THE INVENTION

1. Field of the Invention

The invention relates generally to a tent door and more particularly to a tent door which has a unique zipper assembly to allow venting from top or bottom.

2. Background of the Invention

Numerous types of doors have been utilized for tents and similar portable shelters which are made of flexible materials such as waterproofed canvas materials. The simplest type of these doors were designed for A-frame tents having triangular door openings, i.e., doors with a vertically extending zipper front for easy opening and closing. In a variation of the vertically extending zipper fronts, cords sewn to flaps are provided for tying the doors in a closed position.

In a tent door design having a mesh fabric for providing ventilation, a first set of zippers is typically provided for opening and closing of the passageway into the tent and a second set of zippers is provided for opening and closing of the waterproof fabric to provide venting through the mesh fabric.

FIGS. 1A and 1B show an arrangement of the zippers in a tent door for an A-frame tent having the mesh fabric. FIG. 1A is a view of the tent door from outside the tent whereas FIG. 1B is a view from inside the tent. The outer set of zippers 10, 11 is provided for opening and closing of the passageway into the tent. The inner set of zippers 12, 13 is provided for opening and closing of the waterproof fabric. The dotted lines of FIG. 1A and corresponding solid lines of FIG. 1B indicate that the set of zippers 12, 13, and hence the waterproof fabric, are located on the inside portion of the tent door.

FIGS. 2A and 2B show an arrangement of the zippers in a tent door for a dome tent having the mesh fabric. FIG. 2A is a view of the tent door from outside the tent and FIG. 2B is a view from inside the tent. The outer zipper 20 is provided for opening and closing of the passageway into the tent. The inner zipper 22 is provided for opening and closing of the waterproof fabric. The dotted lines of FIG. 2A and corresponding solid lines of FIG. 2B indicate that the inner zipper 22, and hence the waterproof fabric, is located on the inside portion of the tent door.

FIGS. 3A and 3B show a second arrangement of zippers in a tent door for a dome tent having the mesh fabric. FIG. 3A is a view of the tent door from outside the tent and FIG. 3B is a view from inside the tent. The outer set of zippers 30, 31 is provided for opening and closing the passageway into the tent. The inner zipper 32 is provided for opening and closing the waterproof fabric. The dotted lines of FIG. 3A and corresponding solid lines of FIG. 3B indicate that the inner zipper 32, and hence the waterproof fabric, is located on the inside portion of the tent door.

In each arrangement of zippers of FIGS. 1–3, outer zippers 10 and 11, 20, and 30 and 31 have zipper slides on either side of the tent door. The inner zippers 12 and 13, 22 and 32 have zipper slides only on the inside of the tent door. By having the inner zippers on the inside of the tent door, it is possible for the tent user to provide ventilation while inside the tent.

The primary drawback of the prior art tent doors is that control on the amount of ventilation is limited. The opening of the waterproof fabric is generally from the top and then downward. Ventilation through the bottom portion of the mesh fabric is only possible when the waterproof fabric is completely unzipped. Ventilation through only the bottom section or through only the top and bottom sections exclusive of the midsection is not possible.

SUMMARY OF THE INVENTION

An object of this invention is to provide a tent door which allows the tent to be vented from the top and/or bottom.

Another object of this invention is to provide a tent door having a unique zipper assembly capable of allowing ventilation through the top and/or bottom, exclusive of the midsection.

The above and other objects of the invention are accomplished with a tent door having an air venting fabric as a first ply and a waterproof fabric as a second ply. For the waterproof fabric, a continuous zipper which defines a c-shaped arcuate path is formed. The zipper starts at a side of the tent door and ends at the same side. Zipper slides are mounted on the zipper path, such that a pair of consecutively positioned zipper slides unzips the waterproof fabric to allow ventilation through the air venting fabric when the pair slides towards one another and zips the waterproof fabric to close off ventilation when the pair slides away from each other. Operation of a first one of the pair provides ventilation through the top of the air venting fabric and operation of the other provides ventilation through the bottom of the air venting fabric.

Additional objects and advantages of the invention will be set forth in the description which follows. The objects and advantages of the invention may be realized and obtained by means of the instrumentalities and combinations particularly pointed out in the appended claims.

BRIEF DESCRIPTION OF THE DRAWINGS

The invention is described in detail herein with reference to the drawings in which.

DETAILED DESCRIPTION OF THE EMBODIMENTS

Figure 1A:
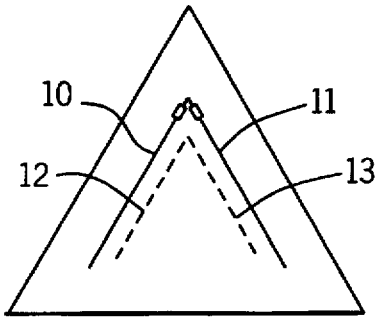
FIG. 1A PRIOR ART
FIG. 1A and 1B are outside and inside views of the tent door of an A-frame tent.
Figure 1B:
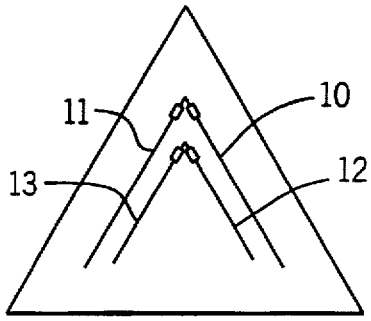
FIG. 1B PRIOR ART
Figure 2A:
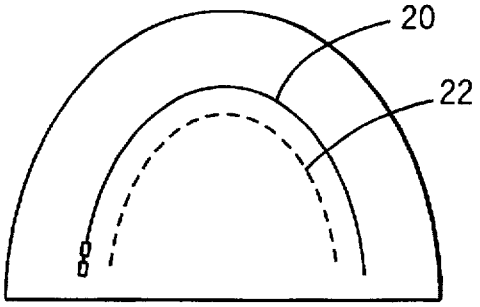
FIG. 2A PRIOR ART
FIG. 2A and 2B are outside and inside views of one type of tent door of a dome tent.
Figure 2B:
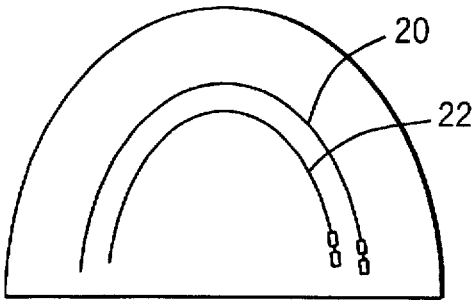
FIG. 2B PRIOR ART
Figure 3A:
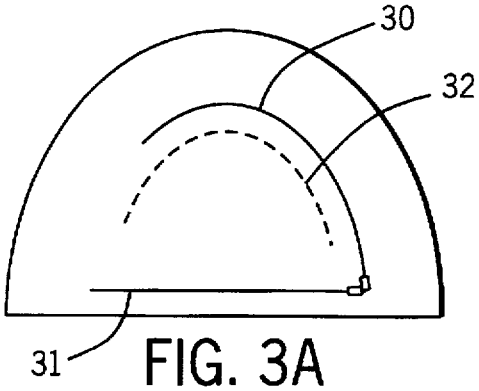
FIG. 3A PRIOR ART
FIG. 3A and 3B are outside and inside views of a second type of tent door of a dome tent.
Figure 3B:
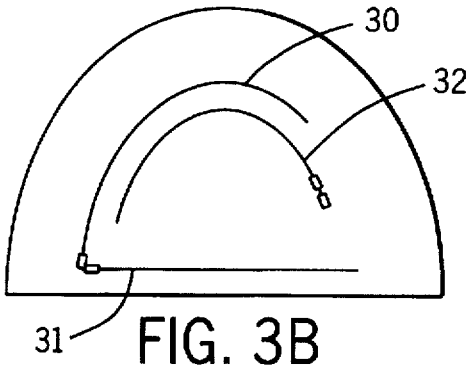
FIG. 3B PRIOR ART
Figure 4A:
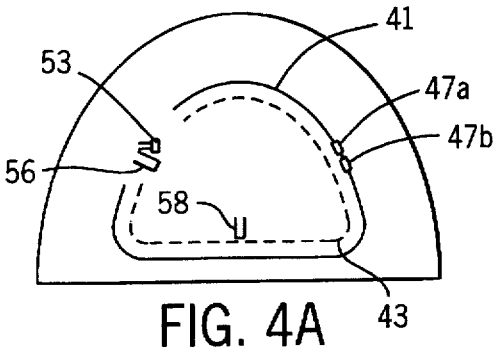
FIG. 4A and 4B are outside and inside views of a tent door according to a first and the preferred embodiment of the present invention.
Figure 4B:
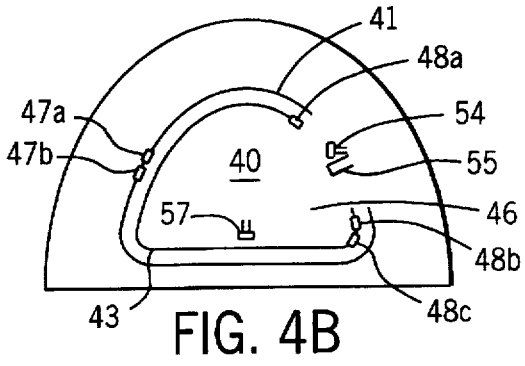

FIG. 4A and 4B are outside and inside views of a tent door according to a first and the preferred embodiment of the present invention. In FIG. 4A, the outline of one face of a tent comprising the tent door 40 is shown. The tent door 40 has a top, bottom, and two sides, right and left. The outline is for a dome or a geodesic dome tent, but the principles of the instant invention are applicable to doors of other types of tents.

The tent door of FIGS. 4A and 4B has two plies, the first being a mesh fabric 45 for allowing air venting therethrough and the second being a waterproof fabric 46 for repelling water. FIGS. 4A and 4B show the waterproof fabric 46 in a closed (zipped) position to block air venting through the mesh fabric 45. Preferably, the waterproof fabric 46 is located on the inside portion of the tent door so that it can be unzipped from the inside.

The arcuate path 41 indicated by a solid line represents the zipper which opens and closes the tent door 40 through zipper slides 47*a*, 47*b*. The arcuate path 43 indicated by dotted lines in FIG. 4A and by a solid line in FIG. 4B represents the zipper which opens and closes the waterproof fabric 46 through zipper slides 48*a*, 48*b*, 48*c* to provide ventilation through the mesh fabric 45. As shown in FIGS. 4A and 4B, the arcuate paths 41, 43 are c-shaped and take on a generally bell-shape. The c-shaped arcuate paths 41, 43 may also take on a generally circular, triangular, square or a rectangular shape.

In the position of zipper slides 47*a*, 47*b*, as shown in FIGS. 4A and 4B, the tent door 40 is closed. When the zipper slides 47*a*, 47*b* are moved away from each other, the tent door is unzipped by the amount of separation between the zipper slides 47*a*, 47*b*. Therefore, the tent door would be completely opened if the zipper slides 47*a*, 47*b* were to be moved to the opposite tips of the c-shaped arcuate path 41.

Similarly, the position of zipper slides 48*a*, 48*b*, 48*c*, as shown in FIG. 4B, corresponds to the situation in which the waterproof fabric 46 is closed. A motion of the zipper slide 48*a* in the counter-clockwise direction is an unzipping direction. A motion of the zipper slide 48*b* in the clockwise direction is a zipping direction. A motion of the zipper slide 48*c* in the clockwise direction is an unzipping direction.

Conversely, a motion of the zipper slide 48*a* in the clockwise direction is a zipping direction; a motion of the zipper slide 48*b* in the counter-clockwise direction is an unzipping direction; and a motion of the zipper slide 48*c* in the counter-clockwise direction is a zipping direction.

The waterproof fabric 46 would be completely opened if zipper slide 48*c* is moved from its shown position adjacent to zipper slide 48*b* to a position adjacent to the shown position of zipper slide 48*a*, or if zipper slide 48*a* is moved from its shown position adjacent to the upper tip of the c-shaped arcuate path to a position adjacent to the shown position of zipper slide 48*c*.

Also shown in FIGS. 4A and 4B are toggles (or dog bones, as is known in the art) 53, 57 with their respective loops 54, 58 which are preferably elastic. The toggle 53 is positioned outside of the mesh fabric 45 and engages with the loop 54 positioned on the inside of the waterproof fabric 46. When the door 40 is completely unzipped, the tent door is folded or rolled and the toggle/loop assembly 53/54 is fastened around the door to maintain the open passageway into the tent.

Figure 5A:
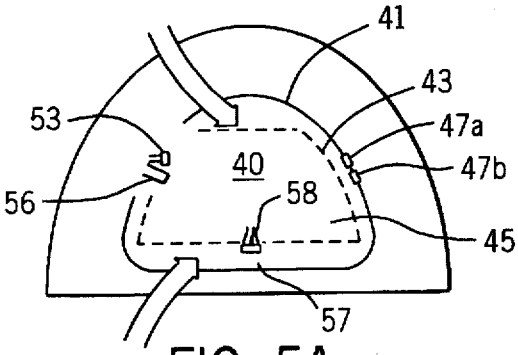
FIG. 5A and 5B are outside and inside views of a tent door according to a first and the preferred embodiment of the present invention wherein the waterproof fabric is partially unzipped to provide venting through the top and bottom.
Figure 5B:
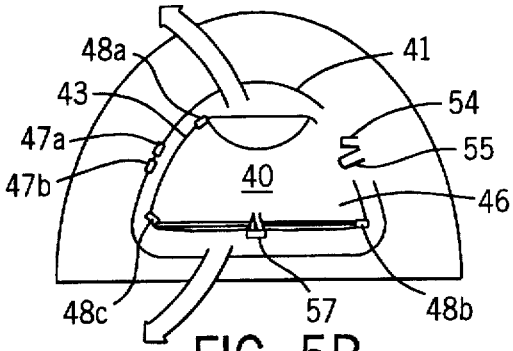

The toggle 57 is positioned inside of the waterproof fabric 46 and engages with a loop 58 positioned on the outside of the waterproof fabric 46, but underneath the mesh fabric 45. As shown in FIG. 5B, when bottom venting is provided through the mesh fabric 45 by moving the zipper slide 48*c* to its shown position, the toggle/loop assembly 57/58 is fastened around the folded or rolled bottom portion of waterproof fabric 46 to maintain the ventilation through the bottom. Venting through the top is provided by moving the zipper slide 48*a* to its shown position. Gravity causes the unzipped portion of the waterproof fabric 46 to droop and allow ventilation through the top.

FIGS. 4A and 4B also show VELCRO® members 55, 56. VELCRO® member 55 is positioned inside of the waterproof fabric 46. VELCRO® member 56 is positioned on the outside of the waterproof fabric 46 underneath the mesh fabric 45. VELCRO® members 55, 56 engage each other such that when the waterproof fabric 46 is completely unzipped to provide maximum ventilation through the mesh fabric 45, the waterproof fabric 46 can be folded and held between the VELCRO® members 55, 56.

Figure 6A:
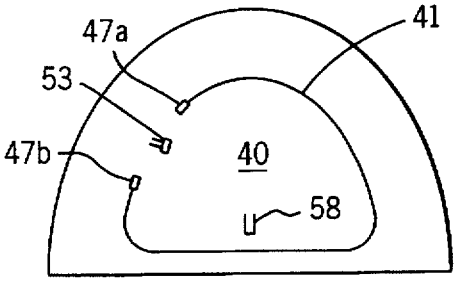
FIG. 6A and 6B are outside and inside views of a tent door according to a second embodiment of the present invention.
Figure 6B:
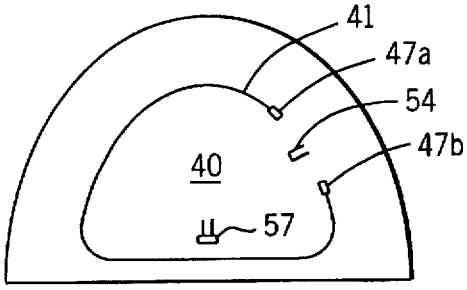

FIGS. 6A and 6B are outside and inside views of a tent door according to a second embodiment of the present invention. In this embodiment, there is only one zipper 41, on which two zipper slides 47*a*, 47*b* are mounted. The tent door 40 is preferably made of waterproof fabric and may be made of a single ply or multiple plies.

As shown, when the zipper slides 47*a*, 47*b* are moved to the opposite tips of the c-shape arcuate path, the tent door is in a closed position. As seen from FIG. 6A, a motion of the zipper slide 47*a* in a clockwise direction or a motion of the zipper slide 47*b* in a counter-clockwise direction unzips the tent door 40. Conversely, a motion of the zipper slide 47*a* in a counter-clockwise direction or a motion of the zipper slide 47*b* in a clockwise direction zips the tent door 40.

Figure 7A:
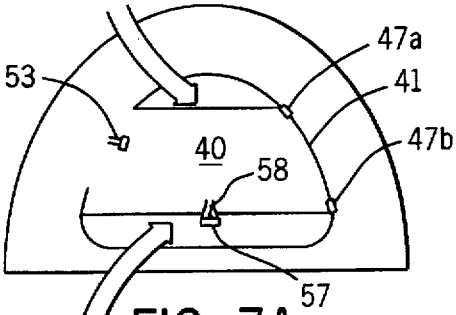
FIG. 7A and 7B are outside and inside views of a tent door according to a second embodiment of the present invention wherein the tent door is partially unzipped to provide venting through the top and bottom.
Figure 7B:
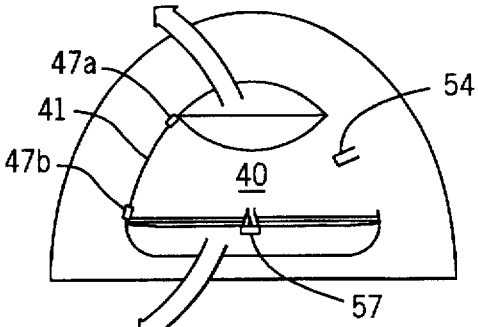

The toggle/loop assembly 53/54 holds the tent door 40 in an open position when the door is completely unzipped, i.e., when zipper slides 47*a*, 47*b* are adjacent to each other at either of the tips of the c-shaped arcuate path. As shown in FIGS. 7A and 7B, the toggle/loop assembly 57/58 holds the tent door 40 in a partially open position so as to provide venting from the bottom portion of the door.

While particular embodiments according to the invention have been illustrated and described above, it will be clear that the invention can take a variety of forms and embodiments within the scope of the appended claims.

We claim:

1. A tent venting mechanism comprising:

an air venting fabric having a top and a bottom;

a waterproof fabric shielding an inside of a tent from water;

a fastening device which controls opening and closing of ventilation through said air venting fabric, said fastening device disposed on said waterproof fabric and allowing simultaneous venting through the top and bottom of said air venting fabric while closing off venting through a midsection of said air venting fabric; and holding means mounted on an outside of said waterproof fabric, said holding means retaining a bottom portion of said waterproof fabric in a folded, vented position.

2. A tent venting mechanism as recited in claim 1, wherein said fastening device is a zipper.

3. A tent venting mechanism as recited in claim 2, wherein said zipper defines a c-shaped path, said c-shaped path starting at a side of said tent venting mechanism and ending at the same side.

4. A tent venting mechanism as recited in claim 3, further comprising a pair of zipper slides on said zipper, each zipper slide unzipping said waterproof fabric to allow ventilation through said air venting fabric when said zipper slide slides towards the other zipper slide and zipping said waterproof fabric to close off ventilation through said air venting fabric when said zipper slide slides away from the other zipper slide.

5. A tent venting mechanism as recited in claim 1, wherein said holding means includes a toggle formed on an inside of said waterproof fabric and a corresponding loop formed on an outside of said waterproof fabric for controlling the height of the ventilation through the bottom of said air venting fabric.

6. A tent venting mechanism as recited in claim 3, wherein the generally c-shaped path is arcuate.

7. A tent door comprising:

a fabric door located in a tent door opening for opening and closing of said tent door opening, said fabric door having an outer ply of an air venting fabric and an inner ply of a waterproof fabric;

a zipper formed on said waterproof fabric, said zipper defining a generally c-shaped path, said path starting at a side of said tent door and ending at the same side, said zipper including a pair of zipper slides, each zipper slide unzipping said waterproof fabric to allow ventilation through said air venting fabric when said zipper slide slides towards the other zipper slide and zipping said waterproof fabric to close off ventilation through said air venting fabric when said zipper slide slides away from the other zipper slide; and holding means mounted on said tent door, said holding means retaining a bottom portion of said tent door in a folded, vented positions, wherein unzipping said waterproof fabric using one zipper slide provides ventilation through the top of said air venting fabric and unzipping said waterproof fabric using the other zipper slide provides ventilation through the bottom of said air venting fabric while a midsection of said air venting fabric remains closed.

8. A tent door as recited in claim 7, wherein said holding means is mounted on an outside of said tent door.

9. A tent door as recited in claim 8, wherein said holding means includes a toggle formed on an inside of said tent door and a corresponding loop formed on the outside of said tent door for controlling the height of the ventilation through the bottom of said air venting fabric.

10. A tent door as recited in claim 9, further comprising one half of a second zipper formed on a rim of said fabric door, the one half of said second zipper coacting with a corresponding half of said second zipper which is formed on an opening for said tent door.

11. A tent door as recited in claim 10, wherein said second zipper also defines a generally c-shaped arcuate path substantially parallel to said first zipper path.

12. A tent door as recited in claim 11, further comprising a second pair of zipper slides mounted on said second zipper, each of said second pair of zipper slides unzipping said tent door open when it slides away from the other zipper slide and zipping said tent door closed when it slides towards the other zipper slide.

13. A tent door as recited is claim 7, wherein the generally c-shaped path is arcuate.

14. A method for venting a tent, the method comprising the steps of:

unfastening a bottom portion of a tent door, the bottom portion being attached to the tent by a zipper having a pair of zipper slides, said zipper having a generally c-shaped path starting at a side of the tent and ending at the same side;

folding the bottom portion of said tent door;

fastening a holding means, said holding means mounted to an outside of said tent door and maintaining the bottom portion of said tent door in a folded, vented position; and unfastening a top portion of said tent door while closing off a midsection of said tent door.

15. A method for venting a tent as recited in claim 14, wherein gravity maintains the top portion of said tent door in a folded, vented position for allowing ventilation through the top and bottom portions.

16. A method for venting a tent as recited in claim 14, wherein said holding means includes a toggle formed on an inside of said tent door and a corresponding loop formed on the outside of said tent door for controlling the height of the ventilation through the bottom portion said tent door.

17. A method for venting a tent as recited in claim 14, wherein the generally c-shaped path is arcuate.

18. A method for venting a tent comprising the steps of:

unfastening a bottom portion of a tent door;

folding the bottom portion of said tent door; and fastening a holding means, said holding means mounted to an outside of said tent door and maintaining the bottom portion of said tent door in a folded, vented position, said holding means including a toggle formed on an inside of said tent door and corresponding loop formed on the outside of said tent door for controlling the height of the ventilation through the bottom portion of said tent door.

19. A method for venting a tent as recited in claim 18, wherein the bottom portion is attached to the tent by a zipper having a pair of zipper slides, said zipper having a generally c-shaped path starting at a side of the tent and ending at the same side.

20. A method for venting a tent as recited in claim 19, wherein the c-shaped path is arcuate.

* * * * *